US010192658B2

(12) United States Patent
Matsumoto et al.

(10) Patent No.: US 10,192,658 B2
(45) Date of Patent: Jan. 29, 2019

(54) CHIP RESISTOR

(71) Applicant: KOA Corporation, Ina-shi, Nagano (JP)

(72) Inventors: Kentaro Matsumoto, Ina (JP); Kotaro Kashiwagi, Ina (JP)

(73) Assignee: KOA CORPORATION, Ina-shi (JP)

( * ) Notice: Subject to any disclaimer, the term of this patent is extended or adjusted under 35 U.S.C. 154(b) by 0 days.

(21) Appl. No.: 15/562,046

(22) PCT Filed: Mar. 8, 2016

(86) PCT No.: PCT/JP2016/057142
§ 371 (c)(1),
(2) Date: Sep. 27, 2017

(87) PCT Pub. No.: WO2016/158240
PCT Pub. Date: Oct. 6, 2016

(65) Prior Publication Data

US 2018/0090247 A1 Mar. 29, 2018

(30) Foreign Application Priority Data

Mar. 31, 2015 (JP) ..... 2015-072214

(51) Int. Cl.
*H01C 1/148* (2006.01)
*H01C 1/012* (2006.01)
(Continued)

(52) U.S. Cl.
CPC ..... *H01C 1/148* (2013.01); *H01C 1/012* (2013.01); *H01C 7/003* (2013.01); *H01C 17/006* (2013.01);
(Continued)

(58) Field of Classification Search
CPC ..... H01C 1/148; H01C 1/012; H01C 7/003; H01C 17/006; H01C 17/22; H01C 17/281
(Continued)

(56) References Cited

U.S. PATENT DOCUMENTS 5,680,092 A * 10/1997 Yamada ..... H01C 7/006 338/308
6,462,304 B2 * 10/2002 Kaida ..... H01C 17/242 219/121.69
(Continued)

FOREIGN PATENT DOCUMENTS

JP 7-183108 A 7/1995
JP 2001-351803 A 12/2001
(Continued)

OTHER PUBLICATIONS

JP 2003-142304, Tsukada, May 2003, machine translation.*
(Continued)

*Primary Examiner* — Kyung Lee
(74) *Attorney, Agent, or Firm* — Crowell & Moring LLP

(57) ABSTRACT

In order to provide a chip resistor which has wide and flat terminal electrodes in its front surface and which has high connection reliability between front electrodes and the terminal electrodes, a chip resistor according to the present invention includes: an insulating substrate 1 shaped like a cuboid; a pair of front electrodes 2 provided on lengthwise opposite edge portions of a front surface of the insulating substrate 1; a resistor body 3 provided between the front electrodes 2; an insulating protection layer 4 covering entire surfaces of the front electrodes 2 and the resistor body 3; and a pair of terminal electrodes 5 provided on lengthwise opposite end surfaces of the insulating substrate 1. The chip resistor is configured such that the front electrodes 2 sandwiched between the insulating substrate 1 and the protection layer 4 are exposed from widthwise end surfaces and the
(Continued)

lengthwise end surfaces of the insulating substrate 1, and the terminal electrodes 5 wrap around the widthwise opposite end surfaces of the insulating substrate 1 to be thereby connected to the exposed portions of the front electrodes 2.

4 Claims, 7 Drawing Sheets

(51) Int. Cl.
*H01C 7/00* (2006.01)
*H01C 17/00* (2006.01)
*H01C 17/065* (2006.01)
*H01C 17/22* (2006.01)
*H01C 17/28* (2006.01)

(52) U.S. Cl.
CPC ..... *H01C 17/065* (2013.01); *H01C 17/22* (2013.01); *H01C 17/281* (2013.01)

(58) Field of Classification Search
USPC ..... 338/309, 307, 332
See application file for complete search history.

(56) References Cited

U.S. PATENT DOCUMENTS 6,609,292 B2 * 8/2003 Kurita ..... H01C 17/006 29/25.42
6,943,662 B2 * 9/2005 Tanimura ..... H01C 1/142 257/537
7,782,173 B2 * 8/2010 Urano ..... H01C 1/012 338/307
7,782,174 B2 * 8/2010 Urano ..... H01C 1/012 338/307
8,354,912 B2 * 1/2013 Yoneda ..... H01C 1/148 338/22 R
2010/0201477 A1 * 8/2010 Yang ..... H01C 1/032 338/309
2015/0061819 A1 * 3/2015 Ogawa ..... H01C 1/142 338/68
2016/0247610 A1 * 8/2016 Shinoura ..... H01C 1/142

FOREIGN PATENT DOCUMENTS

JP 2003-142304 A * 5/2003
JP 2005-268302 A 9/2005
JP 2011-91140 A 5/2011
JP 2015-50234 A 3/2015

OTHER PUBLICATIONS

International Search Report (PCT/ISA/210) issued in PCT Application No. PCT/JP2016/057142 dated May 24, 2016 with English translation (four pages).
Japanese-language Written Opinion (PCT/ISA/237) issued in PCT Application No. PCT/JP2016/057142 dated May 24, 2016 (four pages).
Chinese-language Office Action issued in counterpart Chinese Application No. 201680018608.4 dated Jul. 4, 2018 (six (6) pages).

* cited by examiner

CHIP RESISTOR

TECHNICAL FIELD

The present invention relates to a chip resistor which is suitable for being used as a board inner layer type component.

BACKGROUND ART

Generally, a chip resistor is mainly constituted by an insulating substrate, a pair of front electrodes, a resistor body, an insulating protection layer, a pair of back electrodes, a pair of terminal electrodes, etc. The insulating substrate is shaped like a cuboid. The pair of front electrodes are provided on lengthwise opposite edge portions of a front surface of the insulating substrate. The resistor body is provided between the two front electrodes. The insulating protection layer covers the resistor body. The pair of back electrodes are provided on lengthwise opposite edge portions of a back surface of the insulating substrate. Through the pair of terminal electrodes, the front electrodes and the back electrodes are electrically conductively connected to each other respectively. Trimming is applied to the resistor body in order to adjust a resistance value thereof.

Recently, as the size and weight of an electronic device are reduced or the configuration of a circuit is complicated, there has arisen a case in which such a chip resistor is not only used in a surface-mounted manner on a circuit board but is also used as an inner layer type chip resistor embedded inside a resin layer of a laminate circuit board etc. In this case, a wiring pattern in a front surface of the resin layer is connected to the chip resistor inside the resin layer through via holes. Therefore, it is desirable that front surfaces of the terminal electrodes connected to the via holes are wide and flat. A chip resistor configured to have wide and flat terminal electrodes in its front surface has been known as a configuration example satisfying such a demand (e.g. see Patent Literature 1).

In the configuration of the chip resistor disclosed in Patent Literature 1, the terminal electrodes are extended from front electrodes to positions reaching an upper surface of a protection layer so that the terminal electrodes whose front surfaces are made wide and flat can be formed. Each of the terminal electrodes is formed to cover an overlapping portion (convex) between the corresponding front electrode and the resistor body. Therefore, there is a fear that the front surface of the terminal electrode is not always flat but may be gently uneven.

To solve this problem, a chip resistor having the following configuration has been heretofore proposed, as described in Patent Literature 2. That is, a protection layer is formed to cover entire surfaces of front electrodes and a resistor body, and terminal electrodes are formed to wrap around a flattened upper surface of the protection layer so that front surfaces of the terminal electrodes can be flattened.

CITATION LIST

Patent Literature

Patent Literature 1: JP-A-2011-91140
Patent Literature 2: JP-A-2005-268302

SUMMARY OF INVENTION

Technical Problem

However, when the terminal electrodes are formed on the flattened upper surface of the protection layer as in the chip resistor described in Patent Literature 2, the terminal electrodes can be connected only to the front electrodes exposed in a space between an insulating substrate and the protection layer, i.e. exposed end surfaces corresponding to the thicknesses of the front electrodes. Accordingly, there occurs a problem that connection reliability between the front electrodes and the terminal electrodes may deteriorate. Particularly when the size of the external shape of the chip resistor is reduced, it is necessary to form each of the front electrodes to have a very thin thickness. For this reason, the connection reliability between the front electrodes and the terminal electrodes deteriorates excessively.

The present invention has been accomplished in consideration of the aforementioned actual circumstances of the prior art. An object of the present invention is to provide a chip resistor which has wide and flat terminal electrodes in its front surface and which has high connection reliability between front electrodes and the terminal electrodes.

Solution to Problem

In order to attain the foregoing object, the chip resistor according to the present invention includes: an insulating substrate that is shaped like a cuboid; a pair of front electrodes that are provided on lengthwise opposite edge portions of a front surface of the insulating substrate; a resistor body that is provided between the two front electrodes; an insulating protection layer that covers entire surfaces of the resistor body and the two front electrodes; and a pair of terminal electrodes that are provided on lengthwise opposite end surfaces of the insulating substrate. The chip resistor is configured such that the front electrodes are exposed from widthwise end surfaces and the lengthwise end surfaces of the insulating substrate, and the terminal electrodes wrap around the widthwise opposite end surfaces of the insulating substrate to be thereby connected to the exposed portions of the front electrodes.

In the chip resistor configured thus, the front electrodes covered with the protection layer are exposed from the widthwise end surfaces and the lengthwise end surfaces of the insulating substrate, and each of the terminal electrodes not only extends along the corresponding lengthwise end surface of the insulating substrate but also wraps around the widthwise opposite end surfaces of the insulating substrate to be thereby connected to the exposed portions of the corresponding front electrode. Accordingly, connection reliability between the front electrodes and the terminal electrodes can be enhanced after the flat and wide terminal electrodes are formed on an upper surface of the protection layer.

In the aforementioned configuration, thick film portions in which the front electrodes are formed partially thick are provided, and the terminal electrodes are connected to end surfaces of the thick film portions. In this manner, connection reliability between the front electrodes and the terminal electrodes can be enhanced more greatly.

In this case, it is possible to use a configuration in which only each of portions of the front electrodes is formed into a laminate structure, and the laminate portions of the front electrodes are used as the thick film portions. Alternatively, it may be possible to use a configuration in which recesses are formed in the front surface of the insulating substrate to be connected to the lengthwise end surfaces and/or the widthwise end surfaces, and portions of the front electrodes formed in the recesses are used as the thick film portions.

Advantageous Effect of Invention

According to the present invention, the front electrodes covered with the protection layer are exposed from the widthwise end surfaces and the lengthwise end surfaces of the insulating substrate, and each of the terminal electrodes not only extends along the corresponding lengthwise end surface of the insulating substrate but also wraps around the widthwise opposite end surfaces of the insulating substrate to be thereby connected to the exposed portions of the front electrode. Accordingly, it is possible to provide a chip resistor which has wide and flat terminal electrodes in its front surface and which has high connection reliability between front electrodes and the terminal electrodes.

DETAILED DESCRIPTION OF EMBODIMENTS

Figure 1:
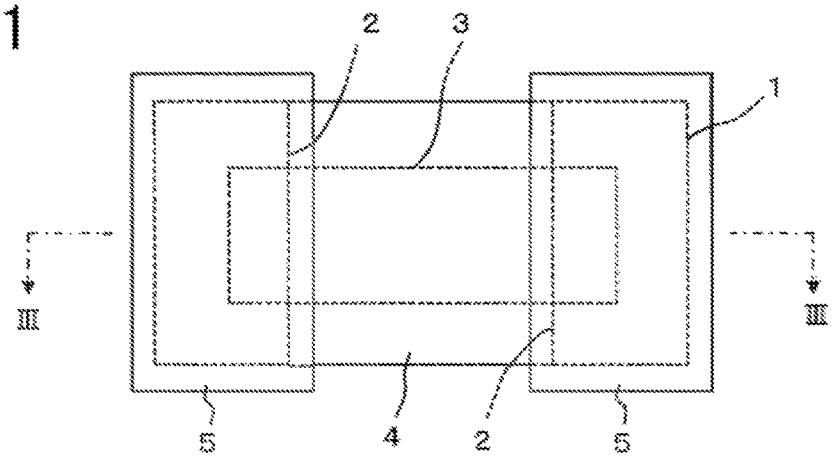
FIG. 1 A plan view of a chip resistor according to a first embodiment of the present invention.
Figure 2:
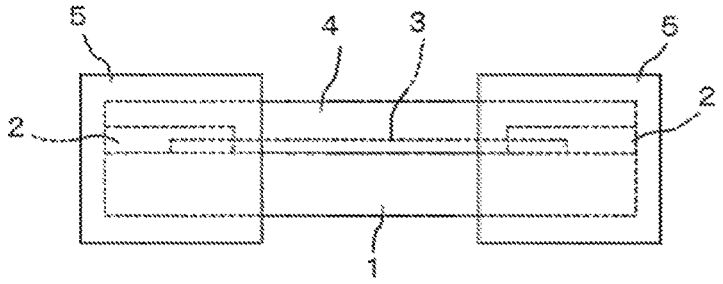
FIG. 2 A side view of the chip resistor.
Figure 3:
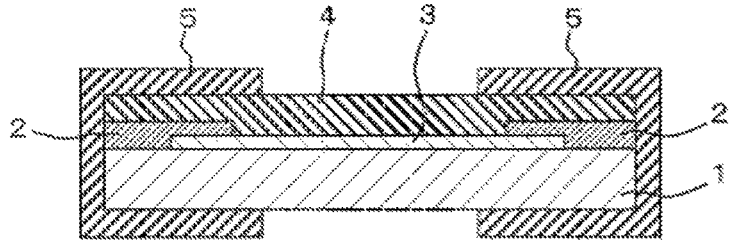
FIG. 3 A sectional view taken along a line of FIG. 1.

A mode for carrying out the present invention will be described below with reference to the drawings. A chip resistor according to a first embodiment of the present invention is a board inner layer type component which is used in an embedded manner inside a resin layer of a not-shown laminate circuit board. As shown in FIGS. 1 to 3, the chip resistor is mainly constituted by an insulating substrate 1, a pair of front electrodes 2, a resistor body 3, an insulating protection layer 4, and a pair of terminal electrodes 5. The insulating substrate 1 is shaped like a cuboid. The pair of front electrodes 2 are provided on lengthwise opposite edge portions of a front surface of the insulating substrate 1. The resistor body 3 is shaped like a rectangle and provided to be connected to the front electrodes 2. The insulating protection layer 4 covers entire surfaces of the two front electrodes 2 and the resistor body 3. The pair of terminal electrodes 5 are provided on the lengthwise opposite edge portions of the insulating substrate 1.

The insulating substrate 1 is made of ceramics etc. A large-sized substrate which will be described later is divided along primary division grooves and secondary division grooves which extend horizontally and vertically. Thus, a large number of the insulating substrates 1 are obtained.

The pair of front electrodes 2 are obtained by screen-printing, drying and sintering an Ag-based paste. The front electrode 2 illustrated on a left side is formed in a rectangular region defined by a left short side of the insulating substrate 1 and two long sides adjacent thereto. The front electrode 2 illustrated on a right side is formed in a rectangular region defined by a right short side of the insulating substrate 1 and the opposite long sides adjacent thereto.

The resistor body 3 is obtained by screen-printing, drying and sintering a resistor paste of ruthenium oxide or the like. Lengthwise opposite edge portions of the resistor body 3 overlap with the front electrodes 2 respectively. Incidentally, although not shown, a trimming groove is formed in the resistor body 3 in order to adjust a resistance value thereof.

The protection layer 4 is formed to cover entire surfaces of the two front electrodes 2 and the resistor body 3. In FIG. 1, a left end surface and opposite upper and lower end surfaces, i.e. a total of three end surfaces, of the front electrode 2 positioned on the left side are exposed from a space between the insulating substrate 1 and the protection layer 4, and a right end surface and opposite upper and lower end surfaces, a total of three end surfaces, of the front electrode 2 positioned on the right side are exposed from the space between the insulating substrate 1 and the protection layer 4.

The pair of terminal electrodes 5 are obtained by dip coating, drying and sintering an Ag paste or a Cu paste. The terminal electrodes 5 are formed to extend along lengthwise opposite end surfaces of the insulating substrate 1 and wrap around predetermined positions of widthwise opposite end surfaces of the insulating substrate 1. Thus, in FIG. 1, the terminal electrode 5 positioned on the left side is connected to the three end surfaces (the left end surface and the opposite upper and lower end surfaces) of the left front electrode 2 exposed from the space between the insulating substrate 1 and the protection layer 4, and the terminal electrode 5 positioned on the right side is connected to the three end surfaces (the right end surface and the opposite upper and lower end surfaces) of the right front electrode 2 exposed from the space between the insulating substrate 1 and the protection layer 4. Incidentally, although not shown, front surfaces of the terminal terminals 5 are plated with Ni, Cu, or the like.

Next, a manufacturing method for the chip resistor configured as described above will be described with reference to FIG. 4 to FIG. 6.

First, a large-size substrate 1A from which a large number of insulating substrates 1 can be obtained is prepared. Primary division grooves and secondary division grooves (both of which are not shown) are provided in a grid pattern in the large-sized substrate 1A. Each of cells partitioned by the two division grooves serves as a chip formation region in which one chip resistor can be formed. Incidentally, the chip formation region in which one chip resistor can be formed is representatively shown in FIG. 4 to FIG. 6. However, in practice, each step which will be described below is performed collectively on the large-sized substrate 1A corresponding to a large number of the chip formation regions in each of which one chip resistor can be formed.

Figure 4:
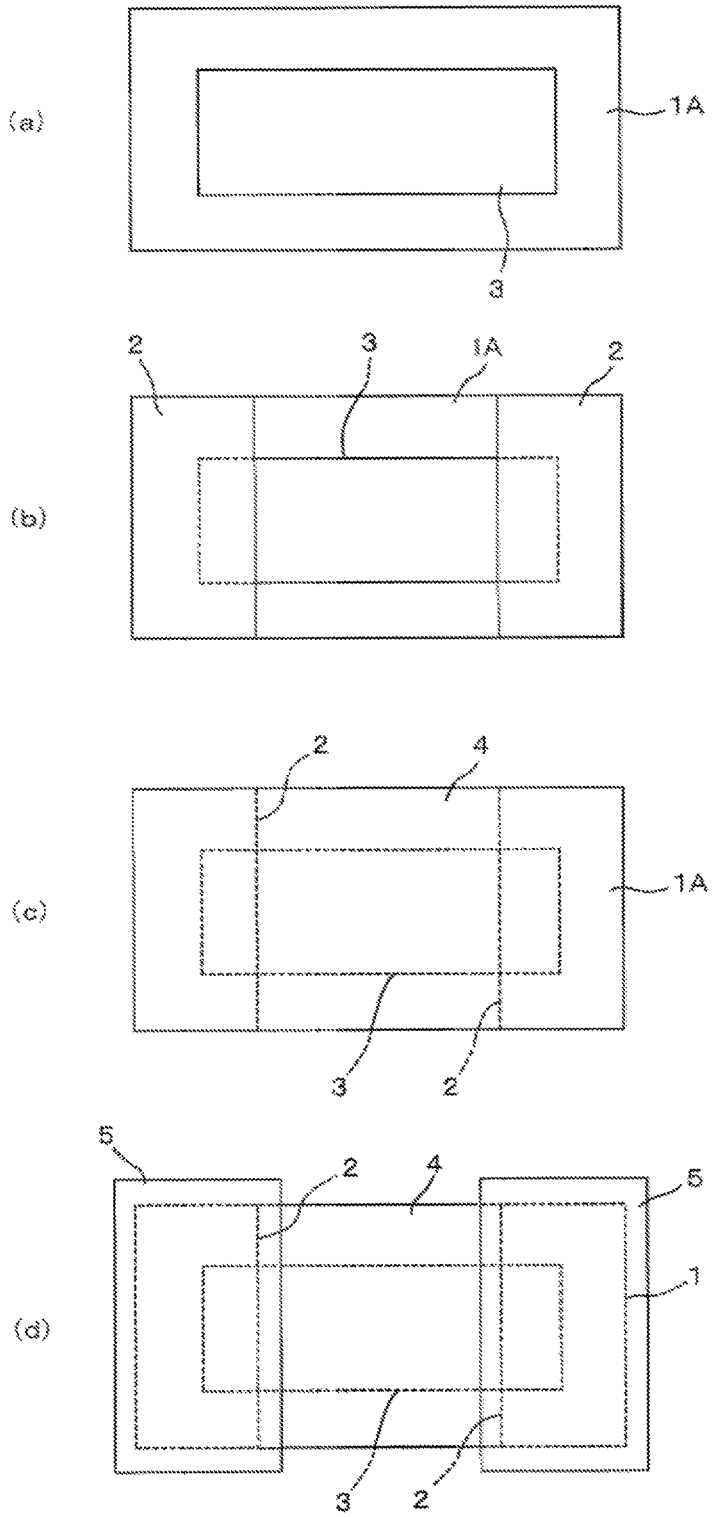
FIG. 4 Plan views showing manufacturing steps of the chip resistor.
Figure 5:
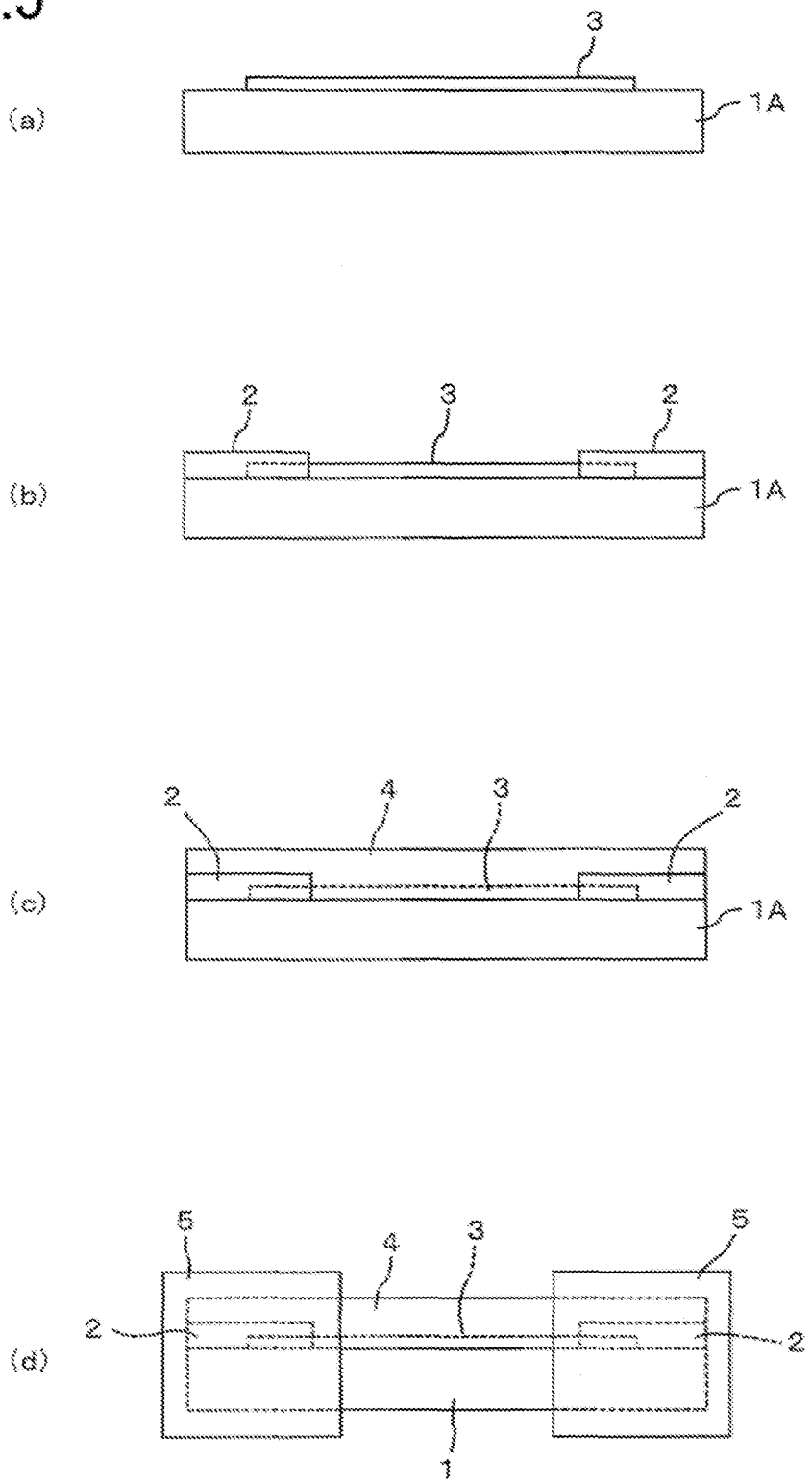
FIG. 5 Side views showing the manufacturing steps of the chip resistor.
Figure 6:
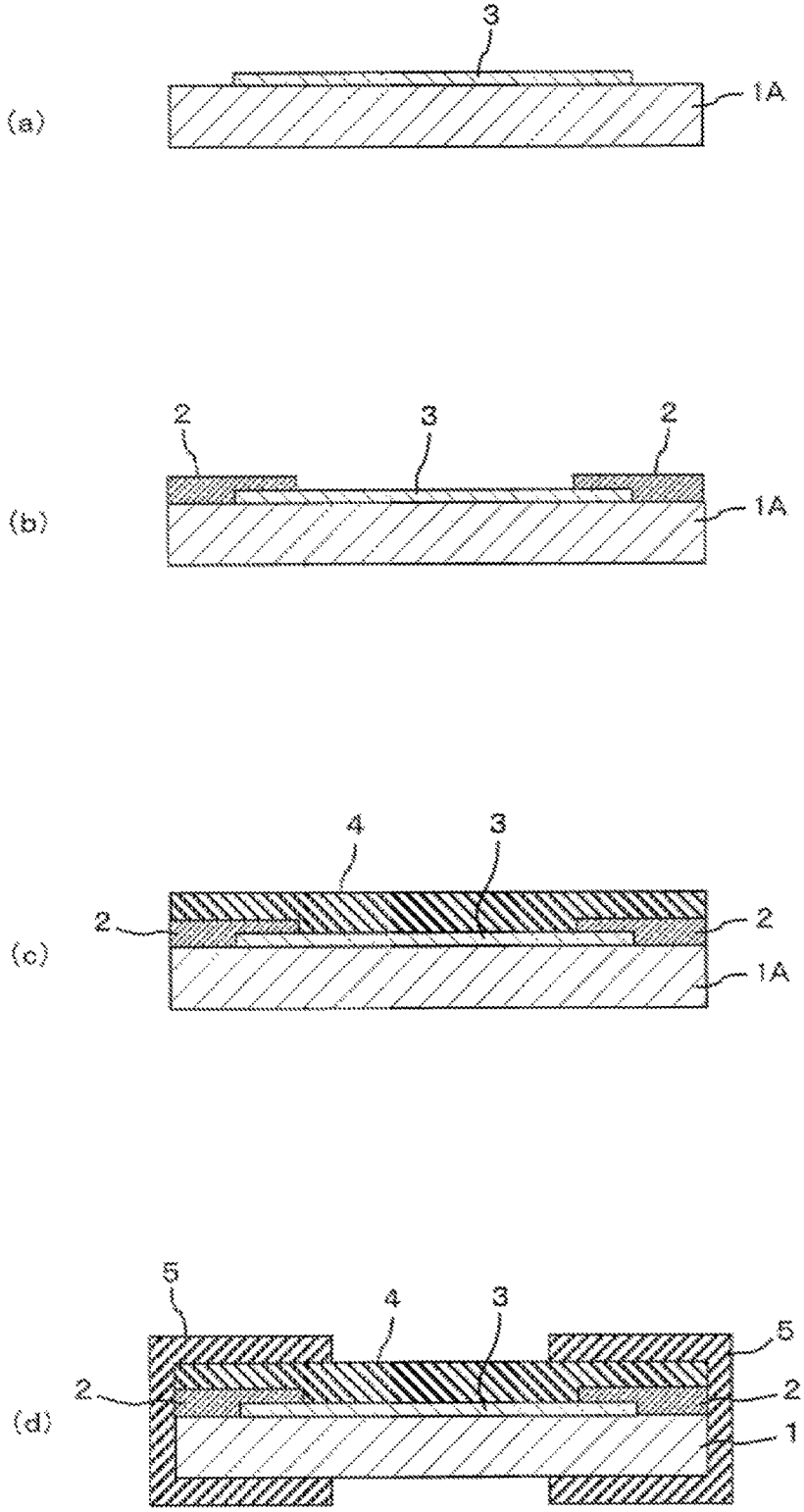
FIG. 6 Sectional views showing the manufacturing steps of the chip resistor.

That is, as shown in FIG. 4(*a*), FIG. 5(*a*) and FIG. 6(*a*), a resistor paste of ruthenium oxide or the like is screen-printed on a front surface of the large-sized substrate 1A, and then dried and sintered. Thus, a rectangular resistor body 3 is formed on a central portion of the front surface of the large-sized substrate 1A.

Next, an Ag-based paste is printed on the front surface of the large-sized substrate 1A, and then dried and sintered. Thus, as shown in FIG. 4(*b*), FIG. 5(*b*) and FIG. 6(*b*), a pair of front electrodes 2 are formed on the front surface of the large-sized substrate 1A to overlap with lengthwise opposite edge portions of the resistor body 3. On this occasion, one of the front electrodes 2 is formed in a rectangular region surrounded by a left short side of an insulating substrate 1 and opposite long sides adjacent thereto, and the other front electrode 2 is formed in a rectangular region surrounded by a right short side of the insulating substrate 1 and the opposite long sides adjacent thereto. Incidentally, the sequence of forming the front electrodes 2 and the resistor body 3 may be reversed to the aforementioned sequence. Specifically, after the pair of front electrodes 2 are formed, the resistor body 3 may be formed so that the lengthwise opposite edge portions of the resistor body 3 can overlap with the front electrodes 2.

Next, as a composition for reducing damage on the resistor body during formation of a trimming groove, a not-shown glass paste is screen-printed, dried and sintered. Thus, an undercoat layer is formed to cover the resistor body 3. Then, the trimming groove is formed in the resistor body 3 through the undercoat layer to thereby adjust a resistance value of the resistor body 3. Thereafter, an epoxy resin-based paste is screen-printed and thermally cured so as to cover the undercoat layer. Thus, a protection layer 4 is formed to cover entire surfaces of the two front electrodes 2 and the resistor body 3, as shown in FIG. 4(*c*), FIG. 5(*c*) and FIG. 6(*c*).

The steps performed so far are batching processing on the large-sized substrate 1A. The large-sized substrate 1A is divided along the primary division grooves and the secondary division grooves by dicing in a subsequent step. Thus, single chips (individual pieces) each equal in size to the chip resistor are obtained. As described above, each of the chip formation regions of the large-sized substrate 1A corresponds to the insulating substrate 1 in which one chip resistor can be formed.

An Ag paste or a Cu paste is dip-coated on lengthwise opposite edge portions of each of the single chips, and then dried and sintered. Thus, a pair of terminal electrodes 5 are formed on lengthwise opposite edge portions of the insulating substrate 1, as shown in FIG. 4(*d*), FIG. 5(*d*) and FIG. 6(*d*). Finally, the terminal electrodes 5 are plated with Ni, Ci, or the like. Thus, a chip resistor shown in FIGS. 1 to 3 is completed. On this occasion, the pair of the terminal electrodes 5 are formed to extend along lengthwise opposite end surfaces of the insulating substrate 1 and wrap around predetermined positions of widthwise opposite end surfaces of the insulating substrate 1. Therefore, one of the terminal electrodes 5 is connected to three end surfaces (a left end surface and opposite upper and lower end surfaces) of the illustrated left front electrode 2 exposed from a space between the insulating substrate 1 and the protection layer 4, and the other terminal electrode 5 is connected to three end surfaces (a right end surface and opposite upper and lower end surfaces) of the illustrated right front electrode 2 exposed from the space between the insulating substrate 1 and the protection layer 4. Accordingly, connection reliability between the terminal electrodes 5 and the front electrodes 2 can be enhanced greatly after the wide and flat terminal electrodes 5 are formed on a flattened upper surface of the protection layer 4.

Figure 7:
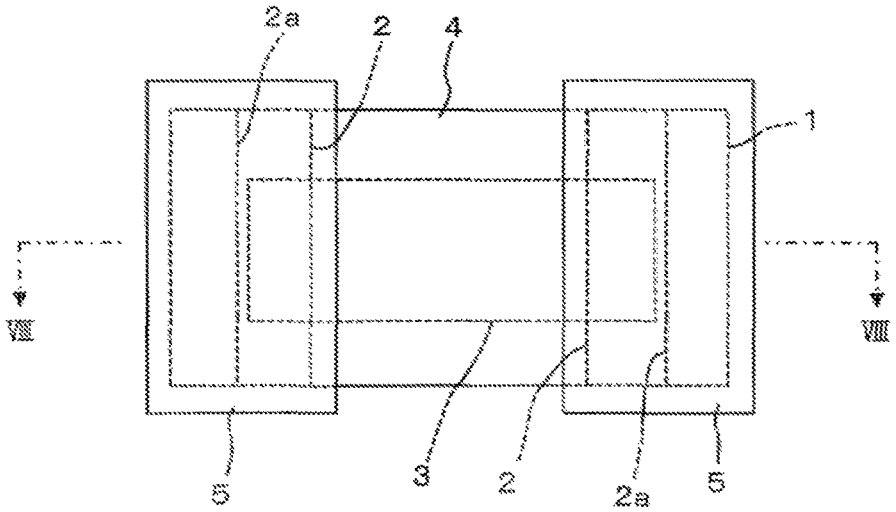
FIG. 7 A plan view of a chip resistor according to a second embodiment of the present invention.
Figure 8:
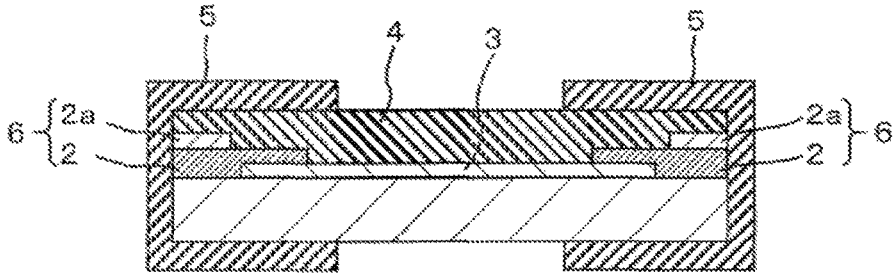
FIG. 8 A sectional view taken along a line VIII-VIII of FIG. 7.

FIG. 7 is a plan view of a chip resistor according to a second embodiment of the present invention. FIG. 8 is a sectional view taken along a line VIII-VIII of FIG. 7. In FIG. 7 and FIG. 8, components corresponding to those in FIGS. 1 to 3 will be referred to by the same signs respectively.

The chip resistor according to the second embodiment is different from the chip resistor according to the first embodiment at a point that edge portions of front electrodes 2 thicker than the other portions of the front electrodes 2 are formed as thick film portions 6 each having a two-layer structure, and terminal electrodes 5 are connected to end surfaces of the thick film portions 6. As for the other configuration, the chip resistor according to the second embodiment is basically the same as the chip resistor according to the first embodiment.

That is, after a pair of the front electrodes 2 are formed to be connected to a resistor body 3, an Ag-based paste is screen-printed on the edge portions of the front electrodes 2, and then dried and sintered, as shown in FIG. 7 and FIG. 8. Thus, auxiliary electrodes 2*a* are formed only on the edge portions of the front electrodes 2 so that the edge portions of the front electrodes 2 can be used as the thick film portions 6 each having the two-layer structure. A protection layer 4 is formed to cover entire surfaces of the front electrodes 2 including the auxiliary electrodes 2*a* and the resistor body 3. Accordingly, in FIG. 7, a left end surface and opposite upper and lower end surfaces, i.e. a total of three end surfaces, of the thick film portion 6 of the front electrode 2 positioned on a left side are exposed from a space between an insulating substrate 1 and the protection layer 4, and a right end surface and opposite upper and lower end surfaces, i.e. a total of three end surfaces, of the thick film portion 6 of the front electrode 2 positioned on a right side are exposed from the space between the insulating substrate 1 and the protection layer 4. Accordingly, the terminal electrodes 5 are connected to the thick film portions 6 of the front electrodes 2 whose exposed areas are increased in the aforementioned manner. Thus, connection reliability between the front electrodes 2 and the terminal electrodes 5 can be enhanced more greatly.

Figure 9:
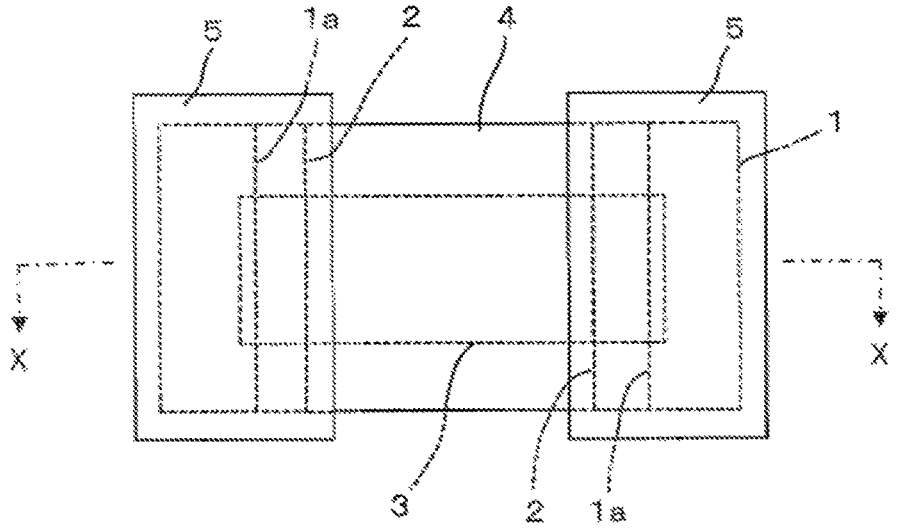
FIG. 9 A plan view of a chip resistor according to a third embodiment of the present invention.
Figure 10:
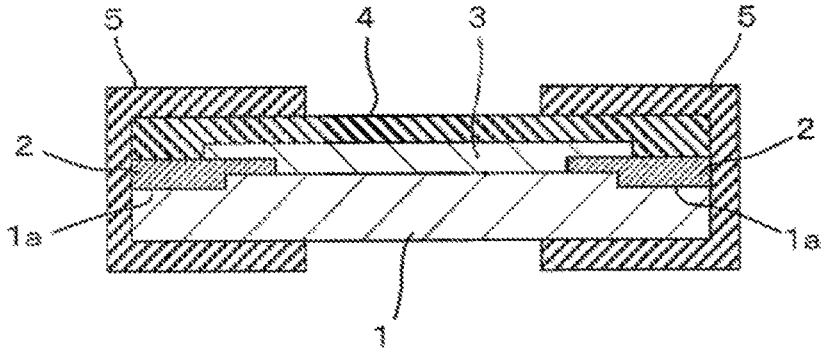
FIG. 10 A sectional view taken along a line X-X of FIG. 9.

FIG. 9 is a plan view of a chip resistor according to a third embodiment of the present invention. FIG. 10 is a sectional view taken along a line X-X of FIG. 9. In FIG. 9 and FIG. 10, portions corresponding to those in FIGS. 1 to 3 are referred to by the same signs respectively.

The chip resistor according to the third embodiment is different from the chip resistor according to the first embodiment at a point that stepped recesses 1*a* are formed in lengthwise opposite edge portions of an insulating substrate 1 and portions of front electrodes 2 are formed in the recesses 1*a* to serve as thick film portions. As for the other configuration, the chip resistor according to the third embodiment is basically the same as the chip resistor according to the first embodiment.

That is, as shown in FIG. 9 and FIG. 10, the recesses 1*a* are formed in the lengthwise opposite edge portions of a front surface of the insulating substrate 1 and each of the recesses 1*a* is connected to a corresponding short side of the insulating substrate 1 and opposite long sides adjacent thereto. The front electrodes 2 are formed on the lengthwise opposite edge portions of the insulating substrate 1 including the recesses 1*a*. Accordingly, the front electrodes 2 are not uniform in film thickness but the portions of the front electrodes 2 formed in the recesses 1*a* serve as the thick film portions to be thicker than any other portion of the front electrodes 2. That is, the front electrodes 2 protruded upward due to the auxiliary electrodes 2*a* serve as the thick film portions in the aforementioned second embodiment, whereas the front electrodes 2 protruded downward due to the recesses 1*a* of the insulating substrate 1 serve as the thick film portions in the third embodiment.

The resistor body 3 is formed on the front surface of the insulating substrate 1 so that lengthwise opposite edge portions of the resistor body 3 can overlap with the front electrodes 2. A protection layer 4 is formed to cover entire surfaces of the front electrodes 2 and the resistor body 3. Therefore, in FIG. 9, a left end surface and opposite upper and lower end surfaces, i.e. a total of three end surfaces, of the thick film portion of the front electrode 2 positioned in the left recess 1*a* are exposed from a space between the insulating substrate 1 and the protection layer 4, and a right end surface and opposite upper and lower end surfaces, i.e. a total of three end surfaces, of the thick film portion of the front electrode 2 positioned in the right recess 1*a* are exposed from the space between the insulating substrate 1 and the protection layer 4. Accordingly, terminal electrodes 5 are connected to the thick film portions of the front electrodes 2 whose exposed areas are increased due to the recesses 1*a*. Thus, connection reliability between the front electrodes 2 and the terminal electrodes 5 can be enhanced more greatly in the same manner as in the second embodiment.

Figure 11:
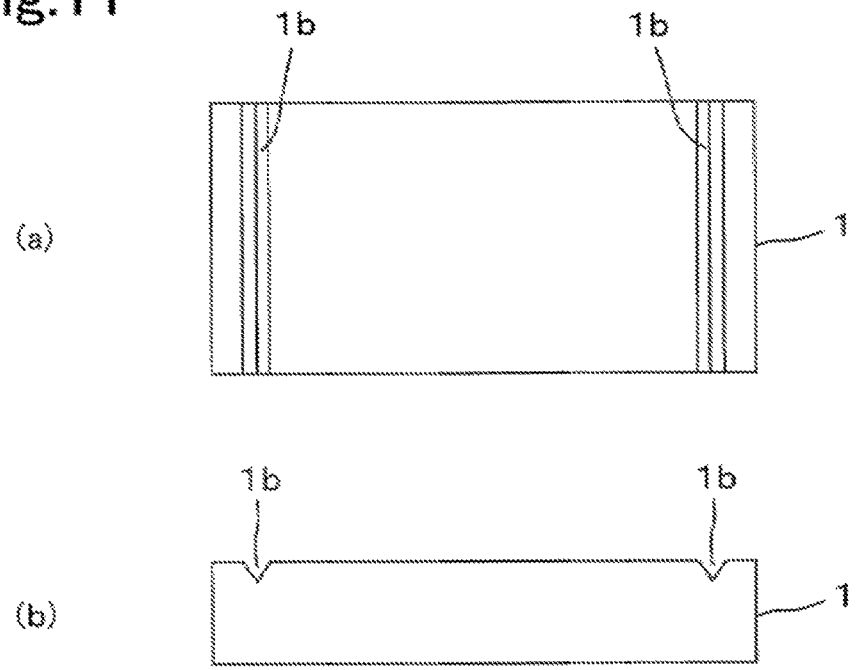
FIG. 11 Views showing a modification of an insulating substrate, FIG. 11(*a*) being a plan view, FIG. 11(*b*) being a sectional view.

Incidentally, the aforementioned third embodiment has been described in the case where the stepped recesses 1*a* are formed in the lengthwise edge portions of the front surface of the insulating substrate 1. Alternatively, V-grooved recesses 1*b* may be formed in the front surface of the insulating substrate 1 by laser machining or the like to extend in parallel and along short sides of the insulating substrate 1, as in a modification shown in FIG. 11. In this case, the recesses 1*b* are connected to widthwise opposite end surfaces of the insulating substrate 1, as apparent from a side view of FIG. 11(*b*). Front electrodes 2 are formed on lengthwise opposite edge portions of the insulating substrate 1 including the recesses 1*b*. Accordingly, thick film portions of the front electrodes 2 formed in the recesses 1*b* are not exposed from lengthwise opposite end surfaces of the insulating substrate 1 but the thick film portions of the front electrodes 2 are exposed from the widthwise opposite end surfaces of the insulating substrate 1. Consequently, in comparison with a case where the front surface of the insulating substrate 1 is formed flat as in the first embodiment, each of exposed areas of the front electrodes 2 can be increased by an amount equivalent to the sectional shape of each recess 1*b*, and connection reliability between the front electrodes 2 and the terminal electrodes 5 can be enhanced accordingly.

Figure 12:
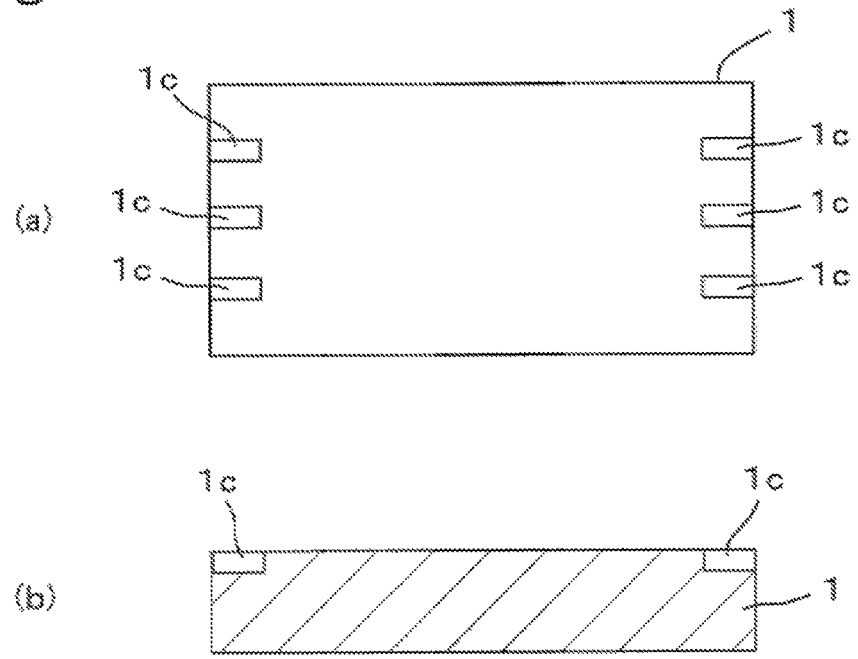
FIG. 12 Views showing another modification of the insulating substrate, FIG. 12(*a*) being a plan view, FIG. 12(*b*) being a sectional view.

Alternatively, a plurality of recesses 1*c* extending inward from the short side of the insulating substrate 1 may be formed in the front surface of the insulating substrate 1 and front electrodes 2 formed in the recesses 1*c* may be used as thick film portions, as in another modification shown in FIG. 12. In this case, the recesses 1*c* are connected to the lengthwise opposite end surfaces of the insulating substrate 1, and the front electrodes 2 are formed on the lengthwise opposite edge portions of the insulating substrate 1 including the recesses 1*c*. Accordingly, the thick film portions of the front electrodes 2 formed in the recesses 1*c* are not exposed from the widthwise opposite end surfaces of the insulating substrate 1 but the thick film portions of the front electrodes 2 are exposed from the lengthwise opposite end surfaces of the insulating substrate 1. Consequently, in comparison with a case where the front surface of the insulating substrate 1 is formed flat as in the first embodiment, each of exposed areas of the front electrodes 2 can be increased by an amount equivalent to the sectional shape of each recess 1*c*, and connection reliability between the front electrodes 2 and the terminal electrodes 5 can be enhanced accordingly.

In addition, although a chip resistor in which electrodes are absent from a back surface of the insulating substrate has been described in each of the aforementioned embodiments, a pair of back electrodes may be formed on lengthwise edge portions of the back surface of the insulating substrate and terminal electrodes 5 may be connected to both the front electrodes and the back electrodes. In this manner, the chip resistor can be connected not only to a wiring pattern on the front surface side of a resin layer but also to a wiring pattern on the back surface side of the resin layer when the chip resistor is embedded inside the resin layer of a laminate circuit board.

REFERENCE SIGNS LIST

1 insulating substrate
1A large-sized substrate
1*a*, 1*b*, 1*c* recess
2 front electrode
2*a* auxiliary electrode
3 resistor body
4 protection layer
5 terminal electrode
6 thick film portion

The invention claimed is:

1. A chip resistor comprising: an insulating substrate that is shaped like a cuboid; a pair of front electrodes that are provided on lengthwise opposite edge portions of a front surface of the insulating substrate; a resistor body that is provided between the two front electrodes; an insulating protection layer that covers entire surfaces of the resistor body and the two front electrodes; and a pair of terminal electrodes that are provided on opposite lengthwise end surfaces of the insulating substrate; wherein: the front electrodes are exposed from opposite widthwise end surfaces and the lengthwise end surfaces of the insulating substrate, and the terminal electrodes wrap around the widthwise end surfaces of the insulating substrate to be thereby connected to the front electrodes only at the exposed portions of the front electrodes that are exposed from the widthwise end surfaces and the lengthwise end surfaces.

2. A chip resistor according to claim 1, wherein: thick film portions in which the front electrodes are formed partially thick are provided, and the terminal electrodes are connected to end surfaces of the thick film portions.

3. A chip resistor according to claim 2, wherein: only each of portions of the front electrodes is formed into a laminate structure, and the laminate portions of the front electrodes are used as the thick film portions.

4. A chip resistor according to claim 2, wherein: recesses are formed in the front surface of the insulating substrate to be connected to at least one of the lengthwise end surfaces and the widthwise end surfaces, and portions of the front electrodes formed in the recesses are used as the thick film portions.

* * * * *